United States Patent [19]

Appleton

[11] Patent Number: 4,867,643

[45] Date of Patent: Sep. 19, 1989

[54] FAN BLADE APPARATUS

[76] Inventor: Arthur I. Appleton, 22 Indian Creek Island, Miami Beach, Fla. 33154

[21] Appl. No.: 196,075

[22] Filed: May 19, 1988

[51] Int. Cl.[4] ..... F04D 29/38

[52] U.S. Cl. ..... 416/175; 416/5; 416/203

[58] Field of Search ..... 416/175 R, 203, 5

[56] References Cited

U.S. PATENT DOCUMENTS

| | | | |
|---|---|---|---|
| 100,216 | 2/1870 | Toense . | |
| 411,312 | 9/1889 | Whitlock | 416/5 X |
| 467,824 | 1/1892 | Myers et al. . | |
| 871,729 | 11/1907 | McChord | 416/5 X |
| 872,307 | 11/1907 | Sargent | 416/175 R X |
| 997,678 | 7/1911 | Jalonick | 416/175 R |
| 1,568,946 | 1/1926 | Generich | 416/175 R |
| 1,699,201 | 1/1929 | Guth | 416/5 X |
| 1,784,072 | 12/1930 | Oliver | 416/175 R |
| 1,916,192 | 12/1931 | David | 416/203 X |
| 2,064,845 | 12/1936 | Moray et al. . | |
| 2,099,196 | 11/1937 | Chapman | 416/175 R |
| 2,104,233 | 1/1938 | Leinweber | 416/175 R |
| 2,269,049 | 1/1942 | Zellweger | 416/175 R |
| 2,333,673 | 11/1943 | Poff | 416/175 R X |
| 2,337,700 | 12/1943 | Wareham | 416/175 R |
| 3,794,443 | 2/1974 | McCarty | 416/175 R |
| 4,391,570 | 7/1983 | Stutzman | 416/175 R X |
| 4,508,958 | 4/1985 | Kan et al. | 416/175 R X |
| 4,548,765 | 10/1985 | Hultholm et al. | 416/175 R X |
| 4,560,321 | 12/1985 | Kawai | 416/5 X |
| 4,640,668 | 2/1987 | Yang | 416/5 X |
| 4,693,673 | 9/1987 | Nee | 416/175 R X |

FOREIGN PATENT DOCUMENTS

| | | | |
|---|---|---|---|
| 1035848 | 8/1958 | Fed. Rep. of Germany | 416/5 |
| 1069279 | 7/1954 | France | 416/175 |
| 289311 | 3/1965 | Netherlands | 416/175 R |
| 91268 | 10/1921 | Switzerland | 416/175 R |
| 361316 | 1/1973 | U.S.S.R. | 416/175 R |

*Primary Examiner*—Everette A. Powell, Jr.

*Attorney, Agent, or Firm*—Jones, Day, Reavis & Pogue

[57] ABSTRACT

A fan having a plurality of blades where a selected number of the blades are arranged with their leading faces disposed parallel to the axis of rotation of the fan. The remaining blades are arranged with their leading faces at angles to the axis of rotation such that the air streams from the two types of blades intersect to create turbulent flow. The fan's heat transfer ability is increased and the air flow from the fan is dispersed over a wider area than with conventional fans.

2 Claims, 2 Drawing Sheets

FAN BLADE APPARATUS

BACKGROUND OF THE INVENTION

The invention relates, generally, to fans and, more particularly, to an improved fan blade design for a ceiling fan.

As is well-known in the art, ceiling fans are secured to the ceiling of a room with the axis of rotation of the blades perpendicular thereto. The fan blades extend radially from the axis of rotation with the blade faces arranged at an angle relative to the horizontal plane such that as the blades rotate through the air they propel the airstream downward in a direction substantially parallel to the axis of rotation. This typical design results in laminar flow of the air.

Laminar air flow in the ceiling fan application is less than desirable for two reasons. First, because the air stream is directed substantially downward, the area affected by the air stream is substantially limited to the area traversed by the fan blades. Second, the resulting laminar flow of the airstream does not produce effective heat transfer. In view of the above-noted shortcomings, there is a need in the fan design art for a fan blade design which can more effectively effect heat transfer over a wider area than the known designs.

BRIEF DESCRIPTION OF THE INVENTION

The fan blade design of the present invention overcomes the above-noted shortcomings of the prior art by providing a fan in which the faces of certain ones of the fan blades are arranged parallel to the axis of rotation of the blades. The resulting air flow can better transfer heat and can affect a larger area than conventional blade designs.

OBJECTS OF THE INVENTION

It is a general object of the invention to provide an improved fan blade design for ceiling fans.

It is another object of the invention to provide an improved fan blade design for ceiling fans which can better transfer heat than the conventional ceiling fan.

It is a further object of the invention to provide an improved fan blade design which disperses the generated airstream over a greater area than conventional fan blade designs.

Other objects of the invention, in addition to those set forth above, will become apparent to one of ordinary skill in the art from the following detailed description.

DETAILED DESCRIPTION OF THE INVENTION

Figure 1:
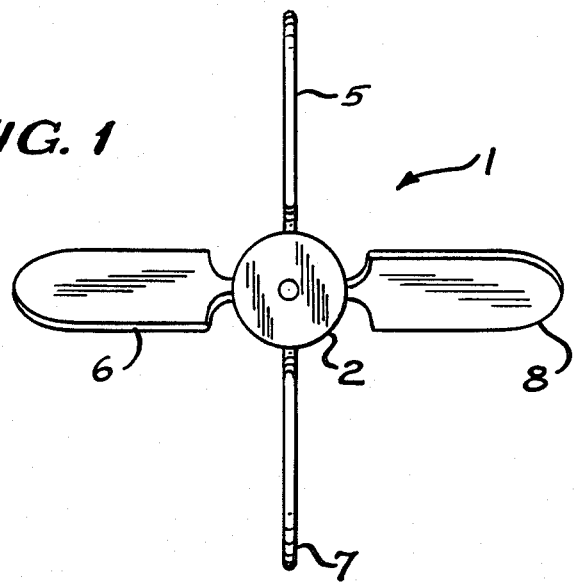
FIG. 1 shows a plan view of a ceiling fan having the improved fan blade design of the first embodiment present invention.
Figure 2:
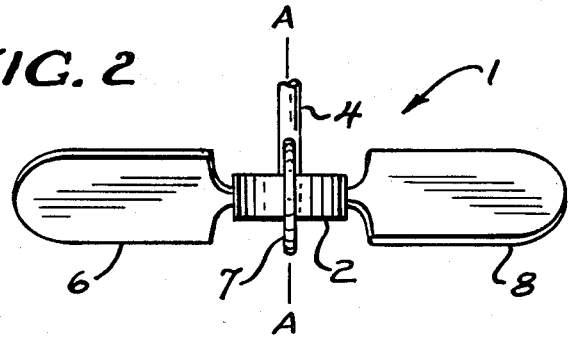
FIG. 2 shows a side view of the fan taken along line 2—2 of FIG. 1.
Figure 3:
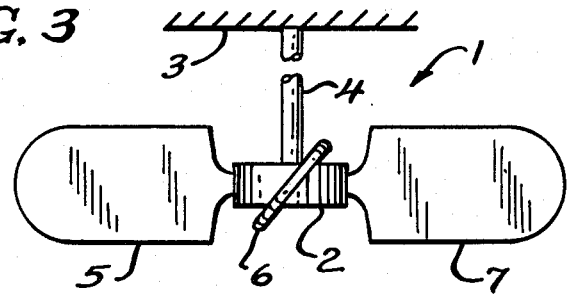
FIG. 3 shows another side view of the fan taken along line 2—2 of FIG. 1.

FIGS. 1, 2 and 3 show a ceiling fan 1 having the fan blade design of the present invention. The fan 1 includes a motor housing 2 mounted to a support 3, such as a ceiling, through shaft 4.

A plurality of fan blades 5, 6, 7, and 8 are evenly spaced about the periphery of the housing 4 and extend radially therefrom. While the illustrated fan is shown with four fan blades, it should be realized that a greater or fewer number of blades may be used if so desired without departing from the scope of the invention. The fan blades 5, 6, 7 and 8 are mounted to a rotatable bearing structure which, upon actuation of the motor, rotates about axis A—A in a plane perpendicular thereto as is well-known in the art.

As illustrated in the Figures, blades 6 and 8 are of conventional construction and have their leading faces 6a and 8a angled with respect to the axis of rotation of the fan A—A such that the airstream generated by these blades is propelled parallel to the axis of rotation. Blades 5 and 7 are arranged with their leading faces **5*a* and 7*a*** disposed parallel to the axis of rotation A—A of the fan such that the airstream generated by these blades is propelled perpendicularly to the axis of rotation of the fan.

As is evident from the preceding description, the airstreams generated by blades 5 and 7 and 6 and 8, respectively, will intersect and produce turbulent, rather than laminer, air flow. As one of ordinary skill in the art will appreciate, turbulent air flow results in better heat transfer than laminer air flow such that a ceiling fan using the blade design of the present invention is better able to provide a uniform room temperature than conventional ceiling fans.

Moreover, the airstream generated by blades 5 and 7 will be propelled beyond the area traversed by the blades themselves such that a larger area can be affected than is possible with conventional ceiling fans. Additionally, since the blade design of the invention does not propel all of the air parallel to the axis of rotation A—A, the area directly beneath the blades will not receive the direct stream of area common to conventional ceiling fans.

Figure 4:
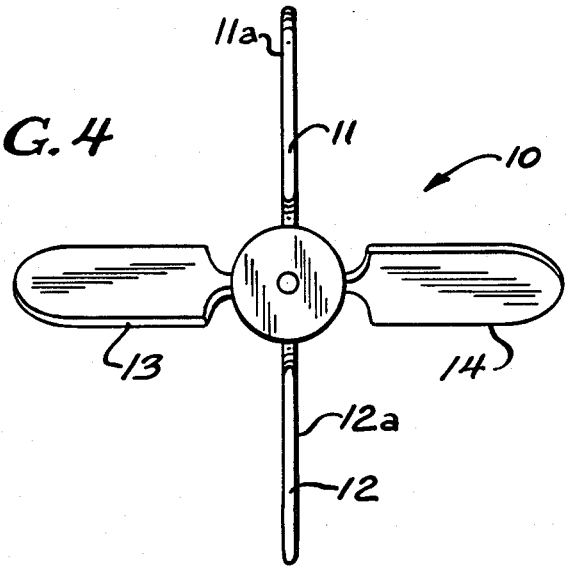
FIGS. 4–6 show views similar to that of FIGS. 1–3 respectively, of a second embodiment of the invention.
Figure 5:
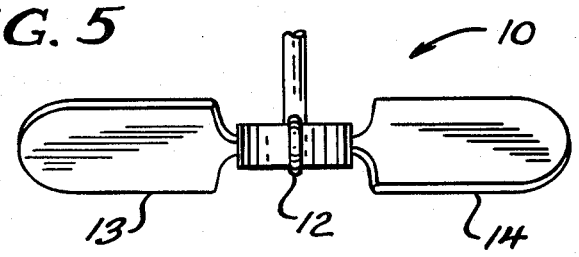
Figure 6:
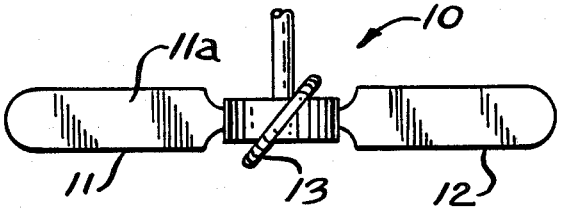

A second embodiment of the invention, shown generally at 10 in FIGS. 4–6, is identical to that of the first embodiment except that the blades 11 and 12 having their leading faces parallel to the axis of rotation of the fan are made smaller in width than conventional blades 13 and 14. This design is used to lower the high resistance on the blades 11 and 12 due to the arrangement of their leading faces **11*a* and 12*a* perpendicular to their direction of movement. The use of the modified blades 11 and 12 allows a smaller motor to be used than that necessary for the embodiment of FIGS. 1–3** while still providing the desired turbulent air flow.

Although the invention has been described in its preferred forms with a certain degree of particularity, it is to be understood that the present disclosure has been made by way of example only. Numerous changes in the details and construction of the combination and arrangement of parts will be apparent without departing from the spirit and scope of the invention.

I claim:

1. A ceiling fan comprising:

a rotating member for rotatably supporting a plurality of fan blades;

means for supporting said rotating member from a ceiling; and a plurality of fan blades secured to said rotating member and extending radially therefrom, selected ones of said plurality of blades being arranged with substantially the entire leading faces thereof disposed parallel to the axis of rotation of said rotating member and the remaining ones of said plurality of blades arranged with their leading faces disposed at angles to the axis of rotation wherein said leading faces are planar, said selected ones of said plurality of blades and said remaining ones of said plurality of blades being alternately arranged about the periphery of said rotating member wherein said fan propels an airstream both perpendicular to and parallel to the axis of rotation of the rotating member such that turbulent air flow is produced.

2. The fan according to claim 1, wherein the area of the leading faces of said selected ones of said plurality of blades is smaller than the area of the leading faces of said remaining ones of said plurality of blades.

* * * * *